US005864767A

United States Patent [19]

Drumgoole et al.

[11] Patent Number: 5,864,767

[45] Date of Patent: Jan. 26, 1999

[54] CHEMICAL BIOLOGICAL EXPLOSIVE CONTAINMENT SYSTEM

[75] Inventors: William J. Drumgoole, Darlington; James A. Genovese, Street, both of Md.; Willem Frederik Vanbasten, Willow Grove, Pa.

[73] Assignee: The United States of America as represented by the Secretary of the Army, Washington, D.C.

[21] Appl. No.: 871,665

[22] Filed: Jun. 9, 1997

[51] Int. Cl.[6] ..... A62D 3/00

[52] U.S. Cl. ..... 588/202; 588/203; 86/50; 102/301

[58] Field of Search ..... 588/200, 202, 588/203; 250/505.1, 517.1, 519.1; 86/50; 102/301

[56] References Cited

U.S. PATENT DOCUMENTS

| | | | |
|---|---|---|---|
| 4,589,341 | 5/1986 | Clark et al. | 102/303 |
| 5,419,862 | 5/1995 | Hampel | 264/84 |
| 5,423,271 | 6/1995 | Schulze | 110/237 |
| 5,574,203 | 11/1996 | Noel et al. | 588/202 |
| 5,584,071 | 12/1996 | Kalyon et al. | 588/200 |
| 5,613,453 | 3/1997 | Donovan | 110/237 |
| 5,660,123 | 8/1997 | Tadmor et al. | 110/216 |
| 5,668,342 | 9/1997 | Discher | 86/50 |

*Primary Examiner*—Ngoclan Mai
*Attorney, Agent, or Firm*—Ulysses John Biffoni

[57] ABSTRACT

A portable apparatus for mitigating the effects of chemical, biological and/or radiological agent containing explosive devices within a defined area is disclosed. The apparatus is an inflatable, easily portable containment device and includes: explosive blast containment means for substantially containing explosive blast over-pressure and blast fragmentation particles caused by an explosive blast to a substantially defined area; chemical, biological and/or radiological agent mitigation means for substantially mitigating the effects of an explosively deployable chemical, biological and/or radiological agent within the substantially defined area; and an inflatable air-beam suspension support structure having a substantially open base portion, a plurality of lateral support members and a capping structure which, when inflated, establishes the substantially defined area and supports the blast containment and agent mitigation means.

26 Claims, 3 Drawing Sheets

CHEMICAL BIOLOGICAL EXPLOSIVE CONTAINMENT SYSTEM

GOVERNMENT INTEREST

The invention described herein may be manufactured, licensed, and used by or for the U.S. Government.

BACKGROUND OF THE INVENTION

1. Field of the Invention

The present invention relates to explosive containment systems. In particular, the invention relates to relatively light weight containment systems which can be used to contain or mitigate the effects of explosively disseminated chemical and/or biological devices.

2. Description of the Related Art

Several countries, many of them hostile to the United States and its allies, currently possess or are seeking to develop the capability to produce nuclear, biological and/or chemical weapons of mass destruction (WMD) and the means to deliver them. Many of these countries also advocate terrorism as a means to achieve their goals. In order to respond to the threat of terrorism using weapons of mass destruction, responding agencies at all levels of government (i.e. local, state and federal) must be adequately prepared to mitigate the hazards to the public and the environment in a timely manner. Terrorists and extortion bombings have always been a problem for law enforcement officials, not only on a national scale, but on an international scale as well. A particular problem to date has been the manner of disposing of a detected bomb or explosive device.

Perhaps the largest single cause of bodily injury in detected explosive devices comes from blasts which take place as the law enforcement officials first on the scene attempt to disarm, or render safe, the bomb or device in order to protect the public and surrounding property. In some cases, the procedure is to detonate the device on site by use of smaller explosive or countercharge to set off the device's main explosive charge. The result is an explosive blast that may cause significant personal or property damage in the immediate area.

Improvised explosive devices (IED's) are the main tools of the trade for some terrorist groups and produce casualties or damage to property through three dynamic processes. The explosion produces high velocity metal fragments or shrapnel, a high velocity compression or blast wave, and a high temperature combustion event termed a fireball. Even small amounts of explosive can be deadly if enough high velocity fragments are disseminated after detonation.

Terrorists may deploy improvised dispersion devices (IDD's) which could effectively disperse chemical or biological hazards as vapors or aerosols. If the hazards are inspired by humans or animals downwind of the dispersion point, they can produce deleterious physiological effects including death.

For relatively small devices which contain either conventional explosives or a combination of an explosive device and chemical, biological, or radiological payload, it may be possible to place a ballistic blanket over the device to inhibit the hazardous effects from the IED or IDD. The difficulty with bomb blankets is that they are quite heavy. The weight of these blankets may require the use of a crane. The bomb blankets could also cause unwanted detonation by coming in contact with antihandling devices placed on the IED or IDD. In addition, conventional bomb blankets are not normally configured with standoff capabilities nor are they adequate in containing secondary hazards such as chemical or biological aerosols.

Since it is not practical to disseminate chemical or biological agents with large amounts of explosive, containment of the explosive is not as big a concern when dealing with chemical and biological devices. The chemical hazard is normally a vapor or off-gassing hazard, while the biological agent is an aerosolized particulate of respirable size. Although some work has been done in the area of containing individual hazards, it has been limited to passive dissemination systems through filtration systems and secondary containment systems.

In summary, prior art explosive containment systems are not well-suited for containment of chemical, biological or radiological agents. The systems often include only metal structures which are of considerable size and weight and are not likely to be man-portable. Furthermore, prior art explosive containment systems for use against improvised explosive devices (IED's) only attempted to contain the effects of the blast over-pressure, fireball and high velocity fragments. Applicants are unaware of previous attempts to mitigate or contain improvised dispersal devices disseminating chemical, biological or radiological hazards.

In view of the need to safely dispose of explosive devices which may contain chemical, biological and/or radiological agents, and further in view of the need to provide containment systems which can be quickly delivered and assembled at remote sites, new and improved explosive containment systems are still required. In sum, there is a need for explosion containment systems that include the wherewithal to mitigate and/or contain chemical, biological, radiological, and explosive hazards. The present invention addresses this need.

SUMMARY OF THE INVENTION

In view of the foregoing, it is therefore an object of the present invention to provide improvements in the containment of explosive devices which contain additional hazards such as radiological, chemical or biological substances.

It is a further object of the invention to provide an explosive containment device which is easily assembled on site and is man-portable.

In one aspect of the invention, these and other objects of the invention are achieved by an inflatable, portable apparatus which includes:

(a) explosive blast containment means for substantially containing explosive blast over-pressure and blast fragmentation particles caused by an explosive blast to a substantially defined area;

(b) chemical, biological and/or radiological agent mitigation means for substantially mitigating the effects of an explosively deployable chemical, biological and/or radiological agent within the substantially defined area; and (c) an inflatable air-beam suspension support structure having a substantially open base portion, a plurality of lateral support members and a capping structure which, when inflated, establishes the substantially defined area, said inflatable suspension structure providing support for said explosive containment means and said agent mitigation means.

In a second embodiment of the invention, there is provided a method of substantially containing an explosive-based device which may contain a chemical, biological and/or radiological agent. The method includes:

(a) providing an inflatable, portable explosive containment apparatus for mitigating chemical, biological and/or radiological agent containing explosive devices, said apparatus having an inflatable air-beam suspension structure;

(b) inflating the inflatable air-beam suspension structure, thereby creating a substantially defined area for containing said explosive devices;

(c) arranging the inflated portable apparatus so that the explosive-based device which may contain a chemical, biological and/or radiological agent is contained within the substantially defined area; and (d) detonating the explosive-based device within the substantially defined area.

The apparatus of the present invention advantageously is an easily portable containment device for containing and disarming explosive devices such as the aforementioned devices (IED's or IDO's). The apparatus allows such hazard-containing explosives to be contained or at least its effects mitigated within a defined area. Of immediate concern to the hazardous materials team or responding law enforcement officials is the preservation of the public health and the environment. Deployment of the inventive system described herein provides responders with a rapidly deployable, man-portable hazard mitigation system that can be used in incidents involving such hazardous devices.

DETAILED DESCRIPTION OF THE PREFERRED EMBODIMENT

The present invention includes an apparatus which is capable of mitigating the effects of explosive blasts and containing fragmentation particles and chemical, biological and/or radiological agents which may be released as a result of detonation of an explosive device. The invention provides a first response team with a rapidly deployable, man-portable, containment apparatus that is effective in reducing hazards to the public or the environment. These hazards can be explosive, chemical, biological and/or radiological in nature. This system is also effective against combinations of these particular hazards.

In one aspect, the present invention includes an inflatable, portable explosive containment apparatus. The portable apparatus is capable of mitigating chemical, biological and/or radiological agent containing explosives and includes:

(a) explosive blast containment means for substantially containing explosive blast over-pressure and blast fragmentation particles caused by an explosive blast to a substantially defined area;

(b) chemical, biological and/or radiological agent mitigation means for substantially mitigating the effects of an explosively deployable chemical, biological and/or radiological agent within said substantially defined area; and (c) an inflatable air-beam suspension support structure having a substantially open base portion, a plurality of lateral support members and a capping structure which, when inflated, defines the substantially defined area. The inflated suspension structure also allows deployment of, and provides support for, the explosive blast containment means as well as the chemical, biological and/or radiological agent mitigation means within the substantially defined area.

Figure 1:
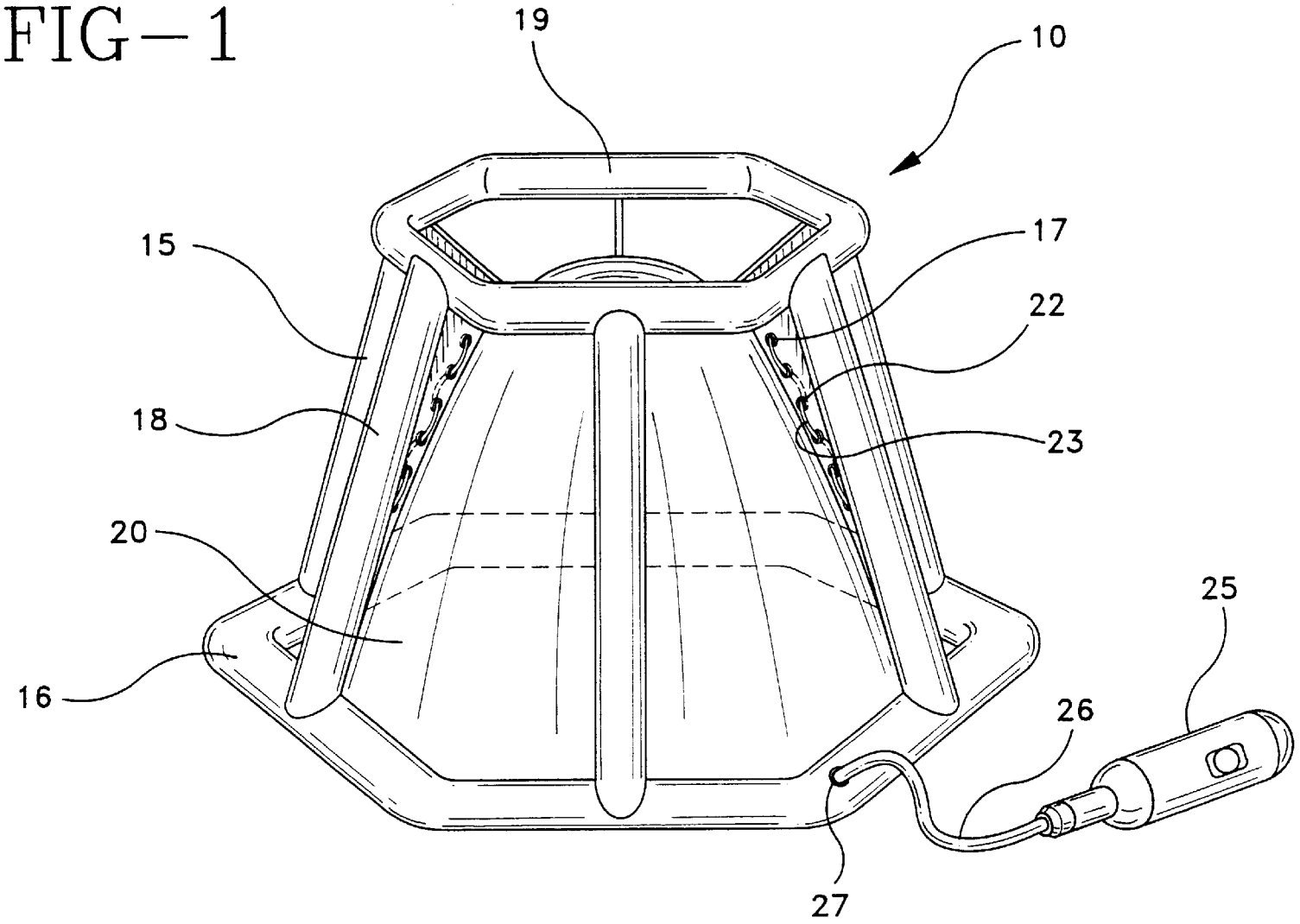
FIG. 1 is a perspective view of a containment device prepared in accordance with the present invention.
Figure 2:
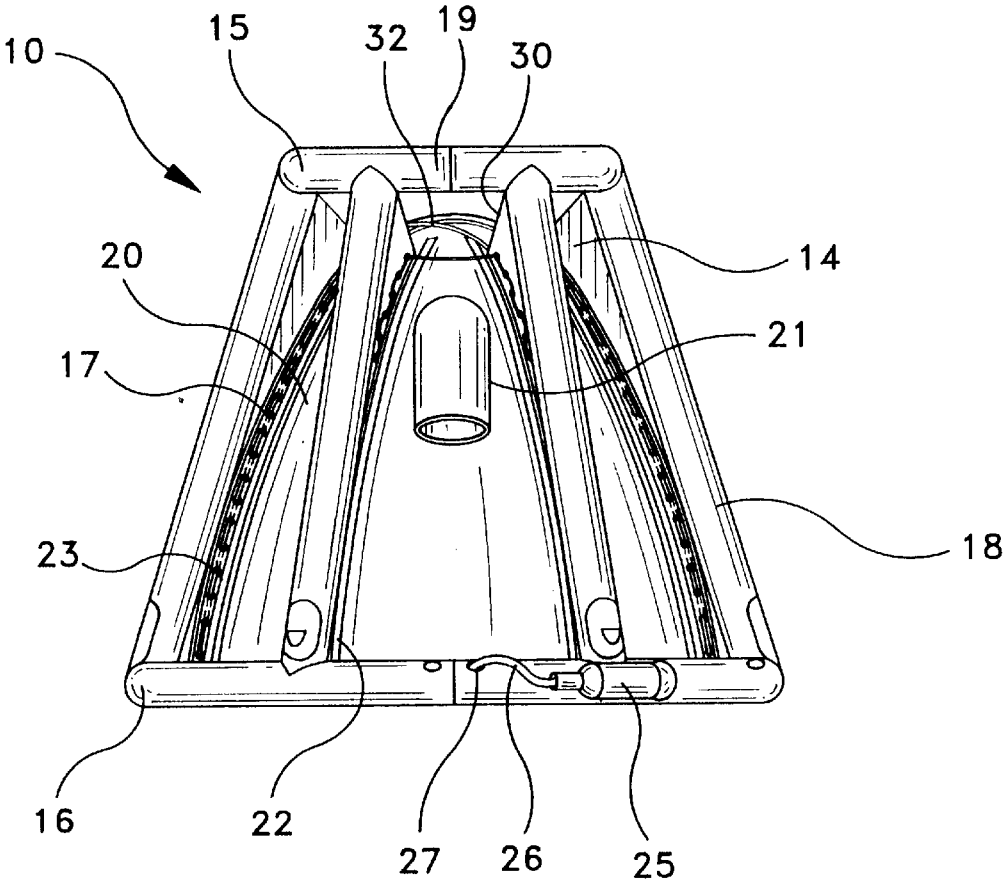
FIG. 2 is a side view of a containment device prepared in accordance with the present invention.
Figure 3:
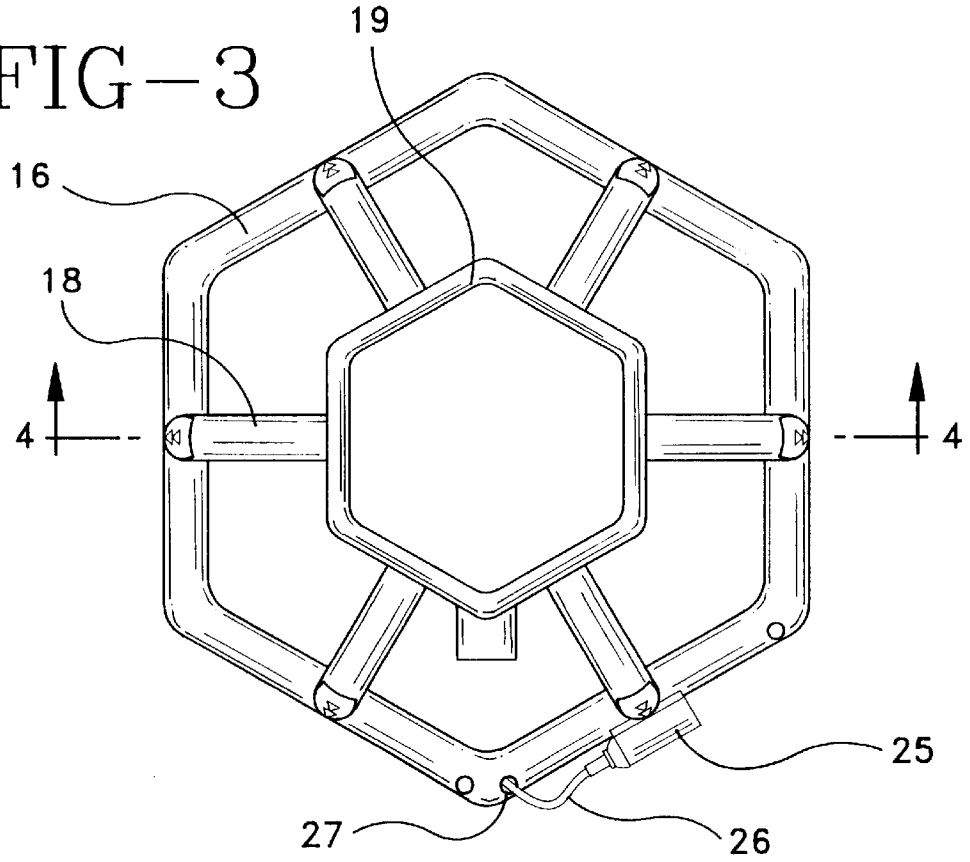
FIG. 3 is a top view of a containment device prepared in accordance with the present invention.
Figure 4:
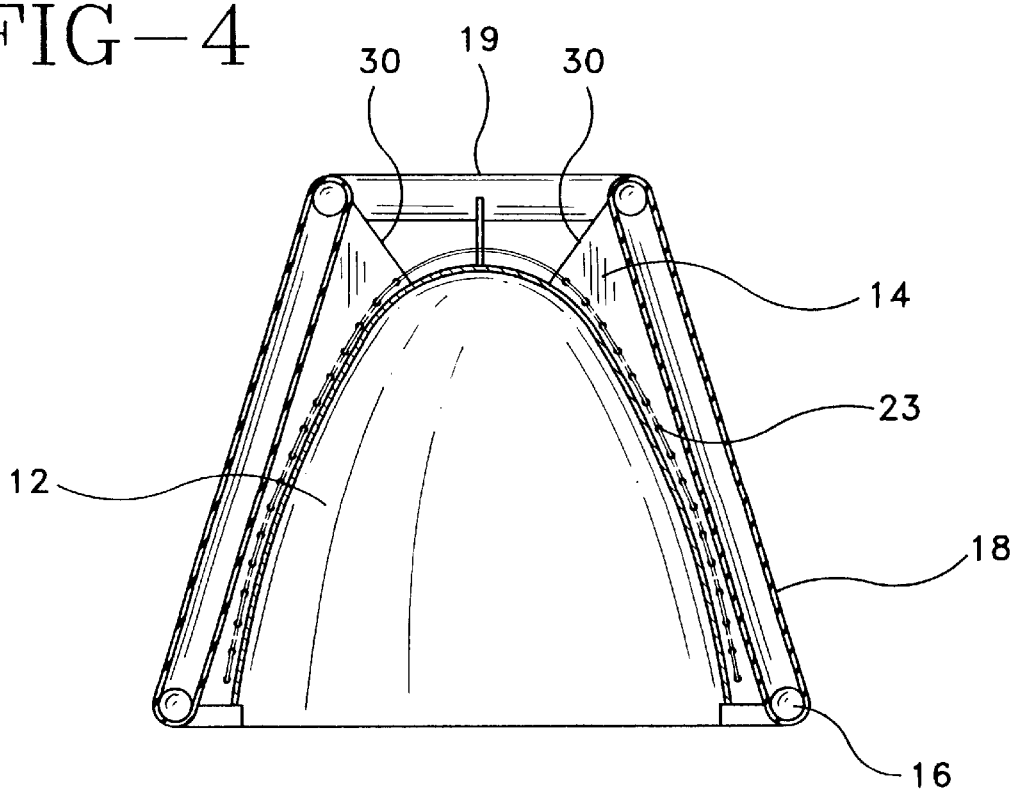
FIG. 4 is cross-sectional side view of a containment device prepared in accordance with the present invention taken along 4—4.

Referring now to the FIGS. 1–4, a preferred containment system 10 utilizing an inflatable air beam support structure 15 is described. One preferred explosive blast containment means includes an explosion containment/agent hazard containment mitigation region 12 which forms the majority of the substantially defined area to which the hazards are contained when the apparatus is io placed on the ground or other surface so that it essentially seals the containment/mitigation region. The containment area is preferably formed using a bomb containment blanket 20 arranged in a tent-like fashion within the air beam support structure. In one preferred embodiment, the containment blanket 20 is arranged parabolically within the inflated air-beam suspension support structure 15. The containment blanket 20 is secured to the inflatable support structure 15 along the base portion 16, each of the lateral support members 18, and the capping structure 19, in a manner which will allow the effects of an explosive blast to be contained within the containment blanket. In the Figures, the containment blanket 20 is attached to the inflatable support structure 15 with a rope or cord 23 joining a series of aligned and/or complementary blanket grommets 22 and support structure grommets 17, found on the air beam extensions 14, in combination with support ring 32 and lateral support member extensions 30. The ballistic barrier or bomb containment blanket 20 can also be supported within the inflatable air beam suspension structure 15 by equivalent joining means. For example, it is contemplated that the blanket can also be joined to the air beam structure using epoxies or the like.

The bomb containment blanket 20 also preferably includes a sleeve or access portal 21, preferably within the capping structure region 19 to allow hazard mitigation foams to be delivered inside the explosion containment/hazard mitigation region 12.

Preferably, the bomb containment blanket is made of suitable ballistic barrier protection materials such as KEVLAR, DYNEEMA, or SPECTRA or other related material that will provide for containment or at least suppression of the hazards due to improvised explosive devices or improvised dissemination devices. These ballistic materials have suppressive characteristics that can contain or retard explosively driven fragments, can suppress or contain blast over-pressure, and suppress combustion fireballs due to an explosive device.

The apparatus of the present invention is designed so that the bomb blanket and the agent hazard containment capabilities accompanying the ballistic barrier are easily folded into a compact package allowing for easy transfer and deployment by one individual. Thus, the inflatable air beam support structure 15 is made of a rubber or other similar inflatable material such as polyester based cloth with UV resistant copolymer coating (calendar coated with welded seams) such as that developed by Siemen Corporation. The air beam structure can be inflated by one of a multiple of inflation means described below and is erectable within seconds. The air beam support structure is configured so that the ballistic bomb blanket barrier 20 is interior to the air beam lateral support members 18 so that these inflatable beams are protected from fragment breaching. This configuration also allows for reuse of the air beam system, if desired.

The inflated system containing the ballistic barrier can be configured in whatever geometry desired, with the understanding that due to the nature of different devices, some shapes may provide more suppression or containment that others. The interior of this inflated structure, referred to herein as the substantially defined area or explosion containment-hazard mitigation area 12 is hollow and has an open area within the base portion 16 (or limited area orifice) so that the apparatus structure can be rapidly and easily placed over a suspected explosive device. The air-beam structure 15 has an optional apron, not shown, at ground level that can be used to secure the apparatus to the ground surface to preclude undue elevation or lift-off after functioning of the IDD or IED.

In practice, the chemical, biological, radiological and explosive containment system is lightweight and can be set up by one person. Preferably, the total weight of the apparatus is less than about 75 lbs. It will be understood that the containment system can be prepared in a variety of sizes and from a variety of materials. Therefore, the exact weight of the apparatus will vary according to the needs of the artisan.

The air beam support structure 15 can be inflated with a small A/C electric pump 25 when commercial power is available. As shown in the Figures, the pump 25 is attached to the air beam intake valve 27 via a hose 26. Preferably, the hose and pump are removable upon need from the system. Alternatively, the system can be inflated by the use of a pressurized gas cylinder, for example, of $CO_2$, such as that normally found on inflatable life rafts and vest for pilots. These pressurized cylinders are discharged by pulling a lanyard. The entire system can be set up in 1 to 3 minutes by one person, or the design is compatible with robotic deployment, if desired.

In addition to the explosion containment means described above, the apparatus of the invention also includes chemical, biological and/or radiological warfare agent mitigation means for substantially mitigating the effects of an explosively deployable chemical, biological and/or radiological warfare agent within said substantially defined area. As stated above, the bomb blanket 20 includes at least one sleeve or access portal 21. The sleeve allows a mitigating agent such an aqueous foam to be delivered within the contained area. Aqueous foams are the preferred mitigation means. Aqueous firefighting foams (AFFF) have unique characteristics that lend themselves to suppression of explosive, chemical, biological or radiological hazards. Aqueous foam can be made quickly, safely and cheaply and are usually biodegradable. The foams are made, for example, by combining water and appropriate surfactant in a high pressure foam generating nozzle placed within the sleeve 21. Aqueous foams can be deployed rapidly and maintain their suppressive characteristics for hours. The foams are also excellent heat sinks to facilitate quenching of the explosive fireballs. Aqueous foam also provides for surprising suppression of the explosive blast wave and even retards high velocity fragments moving through it. In addition, aqueous foams are excellent scavengers of explosively driven aerosols thereby making this medium an excellent choice for suppression of chemical, biological or radiological materials. Aqueous foams by their very nature are water-based and are effective in hydrolyzing (neutralizing) many of the chemical hazards. Portable units of various sizes for making aqueous firefighting foams already exist in the market place and include, for example, SILVEX (Ansul Industries) and PYROCAP. Units are available which dispense from about 2,000 to about 15,000 cubic feet per minute.

Another suitable aqueous based foam is AFC 380 (developed by Sandia Nat'l Lab). It is a non-hazardous material, which is safe for the environment and developed by the Department of Energy Nuclear Emergency Search Team for use with nuclear devices. Although the quantity of foam used in conjunction with nuclear devices is very large in comparison to chemical and biological devices, the technology is compatible and transferrable to the chemical and biological terrorist arena. The foam acts to knock-down chemical vapors and biological particulates or radiological isotopes on impact. Decontamination compounds can be added to the foam to allow chemical, biological and/or radiological neutralization in situ. Alternatively, the pressurized foam can be included as a part of a system which incorporates the air beam inflation devices to allow both foaming and inflation from the same integral source. This would allow the inflatant air to be used as the high pressure source required to generate the aqueous based foam.

One example of this system has been tested with both chemical and biological simulants, and with explosive charges up to 16 ounces of explosive. It will be understood that additional capacity could be provided if desired. The tested system survived well and contained virtually all blast over-pressure, fragmentation (wood, metal and plastic), and chemical and biological simulants. The system can also be oriented to walls, ceilings or floors to accommodate a variety of device placement scenarios. Additional access ports can be designed into separate panels of ballistic materials, i.e. the bomb blanket 20, to allow access for diagnostic equipment and disruption devices. The bomb blanket 20 can also be replaced with a series of ballistic material panels, if needed to allow for maximum efficient fragmentation, aerosol and particulate capture. These designs include, but are not limited to, pleated panels and ballooning sides and top sections for maintaining small man-portable packaging while allowing optimal expansion to accommodate blast overpressure, vapor, particulate and fragmentation capture. These ballistic material panel adjuncts provide expansion capability to absorb more energy and increase volume to reduce explosive effects.

The invention will mitigate up to about 99.9% of chemical vapor hazards for up to 15 minutes as a primary containment system, and can be used in combination with secondary containment systems to provide much longer chemical vapor protection . The invention will also mitigate and contain up to about 99.9% of biological particulate hazards up until the containment apparatus system is physically disturbed.

Although the system mentioned thus far may provide some suppression by itself, it should be used in conjunction with aqueous foam or other suitable hazard suppression medium such as polymeric foam, sorbent material or sawdust. The interior volume space can be filled with aqueous foam or other suppression media through appropriately configured filling ports. The use of aqueous foam in conjunction with the inflatable ballistic barrier provides for a very effective system for containment of either improvised explosive or improvised dispersal devices. The ballistic barrier also serves as a containment vessel for the suppressive foam due to the fluid characteristics of aqueous foam.

In another aspect of the invention, there is provided a method of substantially containing an explosive-based device which may contain a chemical, biological and/or radiological agent. The method includes:

(a) providing an inflatable, portable apparatus as described herein for mitigating the effects of chemical, biological and/or radiological agent containing explosive devices, said apparatus having an inflatable air-beam suspension structure;

(b) inflating said inflatable air-beam suspension structure, thereby creating a substantially defined area for containing said explosive device;

(c) arranging the inflated portable apparatus so that the explosive-based device is contained within the substantially defined area; and (d) detonating the explosive-based device within the substantially defined area.

As will be apparent to those of-ordinary skill, detonation of the suspected device within the substantially defined area can be achieved be counter charge or allowing the device to detonate on its own.

While the invention has been described in connection with preferred embodiments, it will be understood that it is not intended to limit the invention to those embodiments. On the contrary, it is intended to cover all alternatives, modifications and/or equivalents as may be included within the spirit and scope of the invention defined in the appended claims.

What is claimed is:

1. A method of substantially containing an explosive-based device which may contain a chemical, biological and/or radiological agent, comprising:

(a) providing an inflatable, portable apparatus for mitigating, the effects of chemical, biological and radiological agent containing explosive devices, said apparatus having an inflatable air beam suspension structure;

(b) inflating said inflatable air-beam suspension structure thereby creating a substantially defined area for containing said explosive device;

(c) arranging the inflated portable apparatus so that said explosive device is contained within said substantially defined area; and (d) detonating the explosive-based device within said substantially defined area.

2. The method of claim 1, further comprising delivering an agent mitigation means to said substantially defined area prior to detonating the explosive device.

3. The method of claim 1, wherein said agent mitigation means comprises agent neutralizing aqueous foam.

4. The method of claim 1, wherein said agent mitigation means comprises a material selected from the group consisting of polymeric foam, sorbent material and sawdust.

5. A portable apparatus for mitigating the effects of explosive devices which may contain chemical, biological and/or radiological agents, which comprises:

(a) explosive blast containment means for substantially containing explosive blast over-pressure and blast fragmentation particles caused by an explosive blast to a substantially defined area; and (b) an inflatable air-beam suspension support structure for supporting said explosive blast containment means, said support structure having a substantially open base portion, a plurality of lateral support members, and a capping structure.

6. The apparatus of claim 5, further comprising:

chemical, biological and radiological agent mitigation means for substantially mitigating the effects of an explosively deployable chemical, biological and/or radiological agent within said substantially defined area, said agent mitigation means being supported by said inflatable air-beam suspension support structure.

7. The apparatus of claim 5, wherein said explosive blast containment means is a bomb blanket.

8. The apparatus of claim 7, wherein said bomb blanket comprises a ballistic protection material.

9. The apparatus of claim 8, wherein said ballistic protection material is selected from the group consisting of KEVLAR, DYNEEMA and SPECTRA.

10. The apparatus of claim 7, wherein said bomb blanket is arranged parabolically within said inflated air-beam suspension support structure.

11. The apparatus of claim 7, wherein said bomb blanket is substantially joined to said inflated air-beam suspension support structure at said substantially open base portion.

12. The apparatus of claim 7, wherein said bomb blanket is substantially joined to said inflated air-beam suspension support structure at said plurality of lateral support members.

13. The apparatus of claim 7, wherein said bomb blanket is substantially joined to said inflated air-beam suspension support structure at said capping structure.

14. The apparatus of claim 7, wherein said bomb blanket includes access ports.

15. The apparatus of claim 6, wherein said chemical, biological and radiological agent mitigation means comprises a supply of chemical, biological and radiological agent neutralizing aqueous foam delivered to within said substantially defined area.

16. The apparatus of claim 15, wherein said neutralizing aqueous foam is an aqueous firefighting foam.

17. The apparatus of claim 16, wherein said aqueous firefighting foam is selected from the group consisting of SILVEX and PYROCAP.

18. The apparatus of claim 15, wherein said aqueous foam is AFC 380.

19. The apparatus of claim 15, wherein said supply of chemical, biological and radiological agent neutralizing aqueous foam is deliverable to said defined area through an access portal within said explosive blast containment means.

20. The apparatus of claim 15, wherein said aqueous foam further includes a decontamination compound.

21. The apparatus of claim 6, wherein said agent mitigation means comprises a material selected from the group consisting of polymeric foam, sorbent material and sawdust.

22. The apparatus of claim 5, wherein said inflatable air-beam suspension support structure further includes means for inflating.

23. The apparatus of claim 22, wherein said means for inflating is an electric pump.

24. The apparatus of claim 22, wherein said means for inflating is a pressurized gas cylinder.

25. The apparatus of claim 24, wherein said pressurized gas is carbon dioxide.

26. The apparatus of claim 5, further comprising an apron structure at said substantially open base portion for securing said apparatus to the ground.

* * * * *